United States Patent [19]

Gershaw

[11] 3,995,337

[45] Dec. 7, 1976

[54] MATTRESS CONSTRUCTION

[75] Inventor: Gerald Gershaw, Garwood, N.J.

[73] Assignee: Ther-A-Pedic Associates, Inc., Garwood, N.J.

[22] Filed: June 11, 1975

[21] Appl. No.: 585,815

[52] U.S. Cl. ..... 5/345 B

[51] Int. Cl.[2] ..... A47C 23/00

[58] Field of Search ..... 5/345 R, 345 B, 351, 5/345

[56] References Cited

UNITED STATES PATENTS

| | | | |
|---|---|---|---|
| 3,089,154 | 5/1963 | Boyles | 5/DIG. 2 |
| 3,293,670 | 12/1966 | Anson | 5/345 B |
| 3,351,964 | 11/1967 | Anson | 5/345 B X |

*Primary Examiner*—Paul R. Gilliam
*Assistant Examiner*—Andrew M. Calvert

[57] ABSTRACT

An innerspring mattress wherein the middle portion of the mattress has two superposedly arranged sets of springs having different degrees of firmness, a rigid member, such as a plate, being insertable therebetween to provide two additional degrees of yieldability to the mattress. By placing the firmer set of springs either upward or downward and by either inserting the rigid plate therebetween or not, four degrees of flexibility for the mattress are provided. The mattress also comprises an improved handle structure to manipulate the mattress, the handle structure being mounted in cooperative relationship with the coil springs of the mattress construction.

10 Claims, 21 Drawing Figures

Fig.1
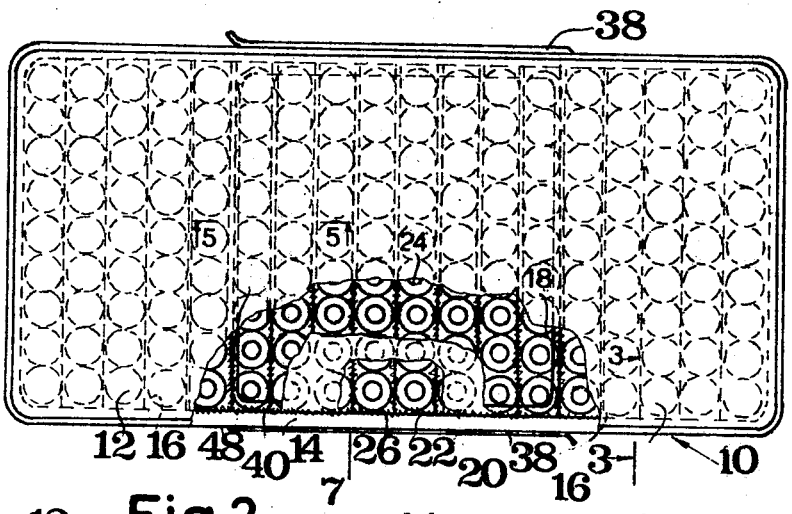
Fig.2
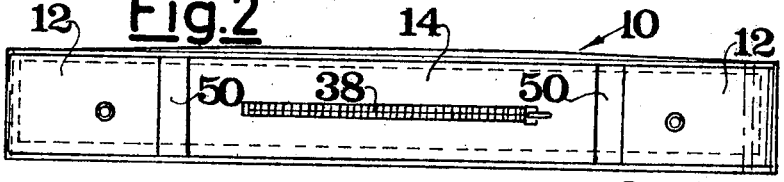
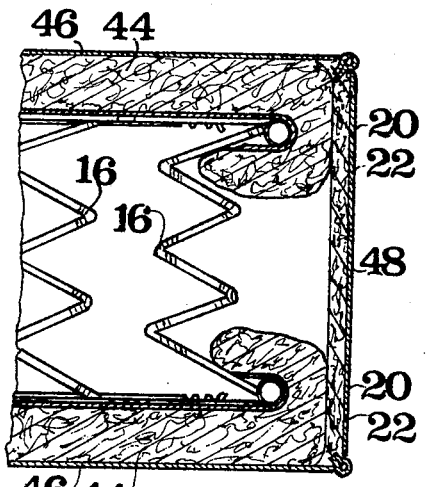
Fig.3
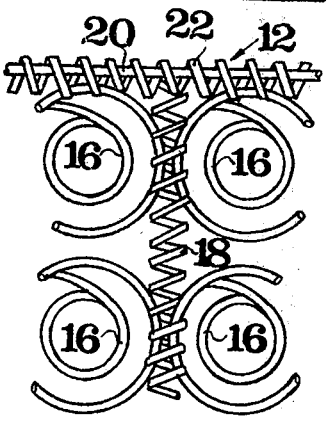
Fig.4

Fig.5
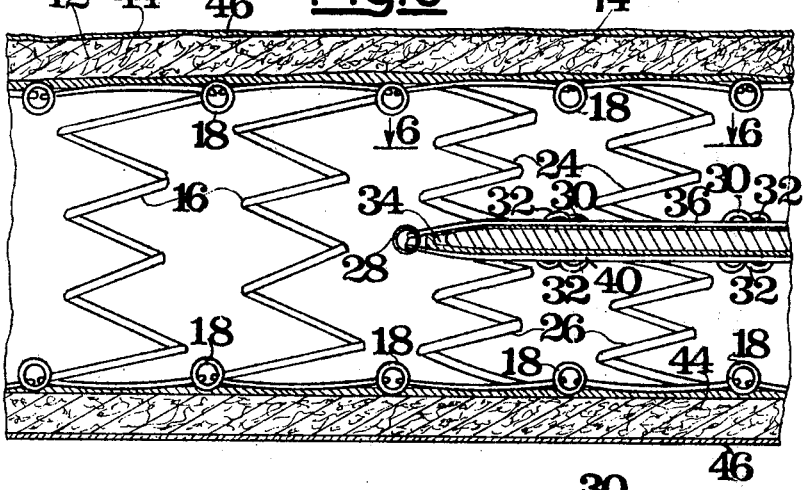
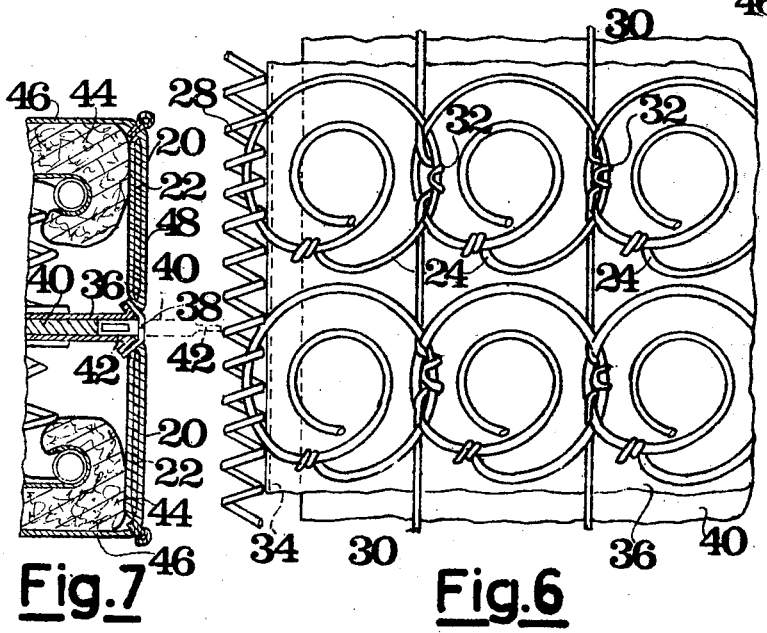
Fig.7
Fig.6

Fig.10
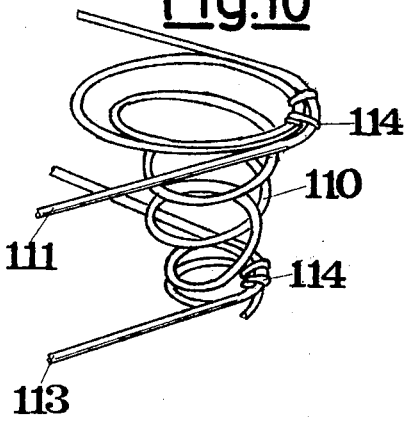
Fig.11
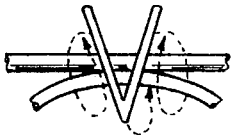
Fig.13
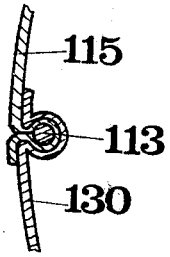
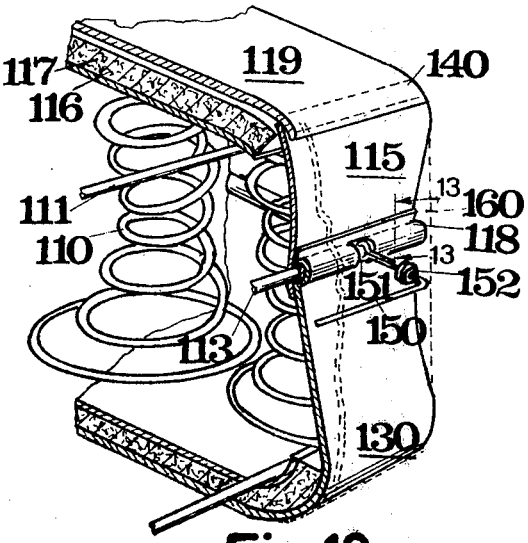
Fig.12
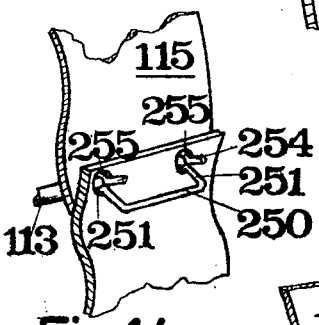
Fig.14
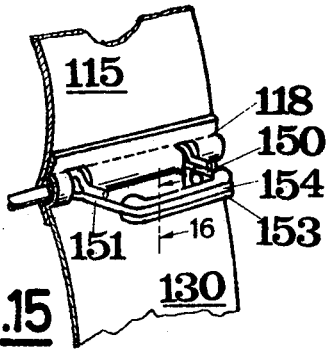
Fig.15
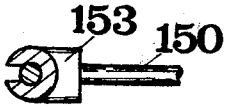
Fig.16

Fig.17
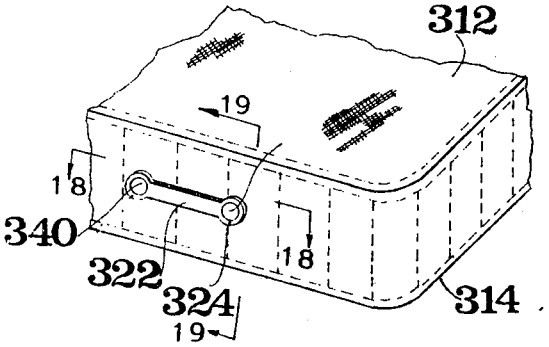
Fig.19
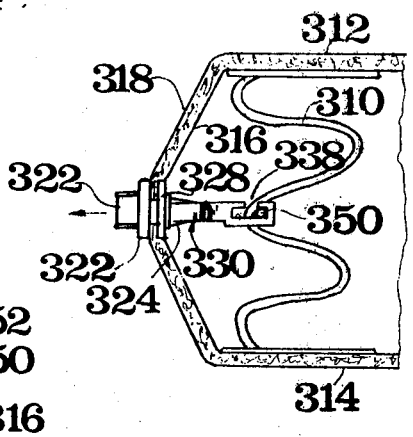
Fig.18
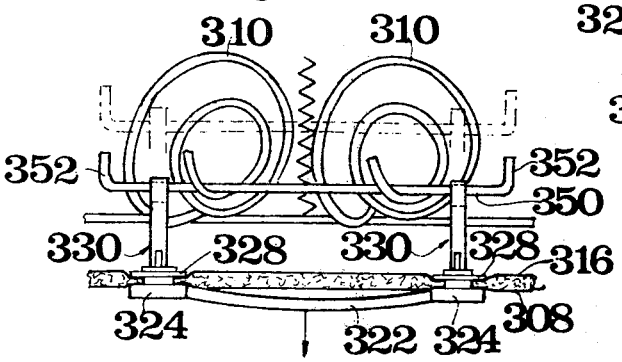
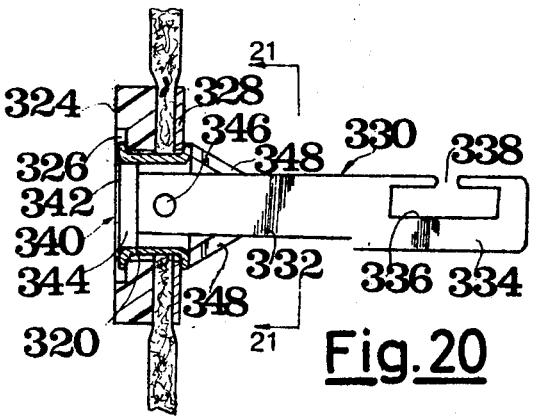
Fig.20
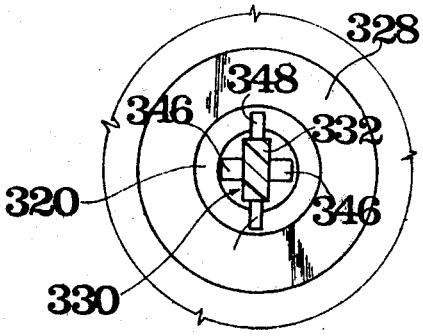
Fig.21

MATTRESS CONSTRUCTION

BACKGROUND OF THE INVENTION

This invention relates to a mattress construction having different degrees of firmness; more particularly, the present invention aims at providing an improved degree of comfort to the user, inasmuch as it is known that, for a correct anatomical posture, it is required that the trunk and the thighs of the user have more yieldable support than the head and the feet.

Thus, the principal object of the present invention is to provide an improved mattress construction in which the firmness or resiliency of the central transverse section of a mattress of the kind having an array of coil springs in its inside, can be varied according to the user's needs and within a reasonably wide range.

Another important object of the present invention is to improve the internal structure of a spring mattress by providing a sort of three-membered skeleton comprising a top border wire, a bottom border wire, and a center wire therebetween, the latter being slightly internally offset with respect to the top and the bottom border wires. The top, bottom and center wire preferably have a substantially rectangular outline, consistent with the usual rectangular shape of a mattress construction. The function of such a three-membered skeleton is to hold the outer canvas cover of the mattress securely in position.

Still another object of the present invention is to provide an improved handle structure for an innerspring mattress, enabling the user conveniently to manipulate the mattress without any risk of damaging the fabric cover of the mattress.

SUMMARY OF THE INVENTION

Briefly described, the improved mattress construction according to this invention comprises, in its central transverse section, two superposedly arranged sets of coil springs having different stiffness ratings or degrees of firmness, and a canvas, duck or the like sleeve or pocket member being inserted between the two superposedly arranged sets of coil springs having different degrees of firmness, the sleeve or pocket member being intended to house a rigid plate or slab member adapted to be inserted therein.

For example, one of the sets of coil spring may be a soft spring array, whereas the other may be composed by springs having a stiffness or firmness greater than that of the one set. With such an arrangement, and assuming that no slidable rigid plate member is inserted in the sleeve or pocket member, two different degrees of firmness become immediately available to the user, namely, the softer degree if the mattress is placed on the bed framing with the softer spring set upwards, and the stiffer or firmer degree in the opposite case. By inserting the rigid plate member into the sleeve or pocket canvas member positioned between the two sets of springs, it is obvious that the available degrees of firmness or stiffness are four rather than two, which is more than enough for fulfilling the requirements of any user.

Preferably, but not compulsorily, the above indicated central transverse section of the mattress arrangement according to the invention occupies roughly one-third of the mattress overall length. The two end sections may be equipped with coil springs of conventional make and arrangement, as usual in the common innerspring mattress constructions.

Another important improvement provided by the present invention over the prior art constructions is the provision of a top border wire, a bottom border wire and a central wire slightly internally offset interposed therebetween, the border wires being arranged substantially tangentially with respect to the mattress helical coils, with a sheet-like cover material being disposed over the mattress, a part of the cover extending from the top border wire to the bottom border wire, and means being further provided for connecting the cover to the center wire.

Still another significant improvement afforded by the present invention is the provision of a handle for conveniently manipulating the mattress whenever it becomes necessary to turn or move same, the handle being mounted in cooperating relationship with the center or intermediate border wire.

Yet a further improvement according to the present invention provides for a manipulating handle which cooperates, through an intermediary rodlike member, with the spirals of a few helical coil springs of the mattress construction.

BRIEF DESCRIPTION OF THE DRAWINGS

The foregoing features, objects and advantages of the present invention will become more clearly apparent from the ensuing description of a few exemplary embodiments of the invention, as illustrated in the accompanying drawings, wherein:

FIG. 1 is a plan view, partly broken away, of a mattress construction of this invention;

FIG. 2 is a side elevation view of the mattress construction of FIG. 1;

FIG. 3 is an enlarged sectional view taken substantially along line 3—3 of FIG. 1;

FIG. 4 is an enlaged fragmentary view showing the snake coil wires tying the coil springs together;

FIG. 5 is an enlarged sectional view taken substantially along line 5—5 of FIG. 1;

FIG. 6 is a sectional view taken substantially along line 6—6 of FIG. 5;

FIG. 7 is an enlarged edge sectional view taken substantially along line 7—7 of FIG. 1;

FIG. 10 is a perspective view showing a portion of an alternative embodiment of an inner spring mattress;

FIG. 11 is an enlarged view of the attaching means shown in FIG. 10;

FIG. 12 is a perspective view of the mattress shown in FIG. 10 is a handle attached thereto;

FIG. 13 is a sectional view taken substantially along line 13—13 of FIG. 12;

FIG. 14 is an enlarged perspective view of a portion of another embodiment of the invention;

FIG. 15 is a view similar to FIG. 14 showing a further embodiment of the invention;

FIG. 16 is an enlarged cross-sectional view taken substantially along line 16—16 of FIG. 15;

FIG. 17 is a fragmentary, perspective view, on a reduced scale, illustrating a further embodiment of the invention and showing a preferred handle structure as applied to an inner spring mattress;

FIG. 18 is a cross-sectional view, on an enlarged scale, taken substantially along the line 18—18 of FIG. 17;

FIG. 19 is a cross-sectional view on an enlarged scale, taken substantially along line 19—19 of FIG. 17;

FIG. 20 is an enlarged elevational view, partly in cross-section and on a greatly enlarged scale, of the handle structure as illustrated in FIG. 19; and FIG. 21 is a cross-sectional view taken substantially along the line 21—21 of FIG. 20.

DESCRIPTION OF THE PREFERRED EMBODIMENTS OF THE INVENTION

Figure 8:
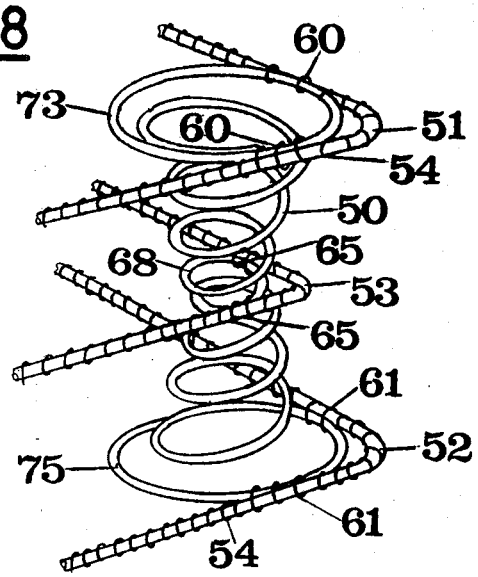
FIG. 8 is an enlarged perspective view showing a portion of the spring and border wire construction of the mattress according to the invention.

The mattress in which the mattress construction of this invention is included, is generally indicated at 10. As outlined above, the mattress construction of this invention consists of two transverse end sections 12 and a transverse middle section 14, the latter section being roughly one third of the entire length of the mattress. Obviously, and generally, mattress constructions are commonly in use, have a rectangular outline, but the above suggest ratio of two-thirds to one-third could be incorporated, for example and with the appropriate adaptations well within the purview of a skilled artisan, to other mattress shapes, such as, for example, polygonal or circular in outline which may be required for certain interior furnishing requirements. As hereinbefore mentioned, what matters is that the trunk and the thighs of the body are provided with a more yielding supporting means than the head and feet.

The coil springs 16 of the end sections 12 are all substantially identical, and are secured together by conventional snake wires 18 and are secured to the mattress rods 20 by means of like conventional snake wires 22.

The middle section 14 of the mattress construction is provided with two separate, superposedly arranged sets of coil springs 24 and 26, the coil springs 24 being secured to each other just as the coil springs 26 are secured to each other. The coil springs 24 and 26 are separate except for the very end loops of the end transverse coils of each set, where they are secured to each other — that is, the end loops of the end coil springs 24 are secured to the end loops of the end coil springs 26 by a snake wire 28, as shown in FIGS. 5 and 6.

While the outermost ends of each of the loops of coil springs 24 and 26 are secured to each other in the same conventional manner by snake wires 18, the inner ends of each of the coil springs 24 are secured to each other by conventional joining wires 30 and intertwined loops 32 securing interengaging end loops of the coil springs, the same construction being used in connection with the inner ends of coil springs 26. However, the inner ends of each set of coil springs 24 and 26 are separate from the inner ends of the other set, except for the end loops of the end coils secured together by conventional snake wires 28, as shown in FIGS. 5 and 6.

The two sets of coil springs 24 and 26, superposed one above the other, are thus separable from each other and provide a passageway 34 therebetween, extending from at least one side of the mattress 10 and, preferably, extending through both sides of the mattress 10. The passageway 34 has a sleeve or pocket member 36 therein, this member 36 being a sleeve if it has entrances at both transverse edges of the mattress 10, or being a pocket if it has an entrance at only one transverse edge. The sleeve or pocket member 36 may be formed of any suitable material such as canvas, duck, ticking or the like.

The entrance at one or both ends is closable by means of a separable fastener 36 of any suitable type, often commonly known in one form as a "zipper". Insertible through the entrance to the pocket after opening the zipper 38, is a rigid plate 40 of any suitable material having a handle grip 42 at either or both edges to facilitate the entry or removal of the plate 40 into or out of the pocket or sleeve 36.

The mattress construction is enclosed within conventional padding 44 and ticking 46, with the usual edging 48, and the mattress itself may be provided with spaced handles 50 in a conventional manner, facilitating handling of the mattress.

The set of springs 24 differs from the set of springs 26 in the firmness of the springs, the set of spring 24 being indicated as a soft spring, while that at 26 is a hard spring. The differences in firmness of the two springs, making one a soft spring and the other a hard spring, is provided in any conventional manner, such as by making the springs of different gauges of wire, or of wires of different strength, or different number of coils in the wire, or in any other conventional manner.

In operation, the user may select the degree of firmness that he desires according to which face of the mattress he places upwardly, and he has four different degrees of firmness available.

For the softest mattress, he removes the plate 40 and places the soft spring set 24 uppermost. For a slightly harder degree, he inserts the rigid plate 40 into position by manipulating the zipper 38 to permit its entry. For a greater degree of firmness, he will reverse the mattress and place the hard set of springs 26 uppermost, and for the maximum degree of hardness, he will insert the rigid plate 40 with the set of hard springs 26 uppermost.

As outlined above, the user may thus conveniently vary the degree of firmness of the mattress, and more accurately of the middle third thereof, according to his desire and health condition; it being noted that, when the stiff plate 40 is inserted, the middle section of the mattress may bulge slightly upwardly, as depicted in FIG. 2.

Figure 9:
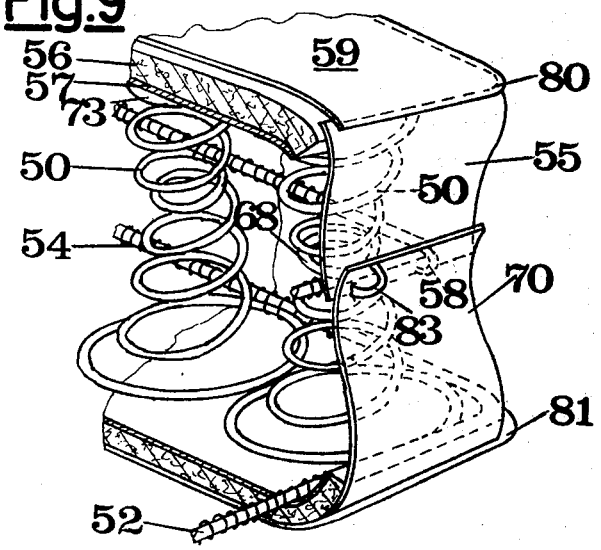
FIG. 9 is a view similar to FIG. 8 showing a cover and padding in position on the springs.

FIGS. 8 and 9 of the accompanying drawings are particularly related to a border wire, center wire, and cover assembly.

The particular construction is disclosed in these Figures provides a means for attaching the cover in a centrally located position between the top and the bottom of the mattress whereby the cover is held positively in position with relation to the top and bottom of the mattress.

Now, with more particular reference to FIGS. 8 and 9 of the drawings, the mattress construction is made up of the usual coil springs 50, top border wire 51, bottom border wire 52 and intermediate wire 53. The top, bottom and intermediate wires are provided with helical wires 54 which are wrapped around the top, bottom and intermediate border wires and each are twisted around a turn of the helical support springs 50 at 60, 61 and 65 of the top turn 73, intermediate turn 68 and lower turn 75, respectively, of the coil springs.

The top border wire 51 and bottom border wire 52 may be formed into a generally rectangular frame, and the helical support springs 50 at each corner will be attached to both the front and the end portion of each. Therefore, one of the coil springs 50 is disposed directly in each corner of the mattress. The top and bottom border wires each define a frame slightly larger than the intermediate border wire 53.

The intermediate wire 53 will be connected to the cover part 55 by means of hog rings 58 which will extend through the cover part 55 after it has been pulled taut and around the center wire 53 and the center coil of the coil spring 50. These hog rings 58 will be attached to each coil spring and the rings will be placed at spaced portions completely around the outer periphery of the mattress.

After this is completed, the mattress is inverted and the cover part 70 is pulled taut in the same fashion overlapping cover part 55 and the cover parts 70 and 55 will be hog ringed to the center wire and the outside coil springs by means of rings 83. Thus, the cover parts 55 and 70 will be fixed to the center wire 53 as well as to the center turn of the coil springs adjacent thereto. Since the center wire 53 is slightly inside a plane passing through the margin of the top and bottom border wires 51 and 52, the cover parts 55 and 70 will be held slightly inside the upper and lower marginal parts.

The mattress may have the usual felt padding 56, sisal pad 57, and top cover material 59 sewn to the flange cover material 55 at seam 80. The bottom cover material 81 may likewise be sewn to the flange cover material 70 in the same fashion.

The embodiment depicted in FIGS. 10 to 16 inclusive is an improvement over that shown in FIGS. 8 and 9 and shows also a handle structure combined with the innerspring mattress construction.

The mattress construction as shown in FIGS. 10 to 16 essentially comprises the usual coil springs 110, top border wire 111, bottom border wire 112 and intermediate border wire 113. The members listed above are the equivalents of the items 50, 51, 52 and 53 of FIGS. 8 and 9 and need not be described in detail. Differently from the construction shown in FIGS. 8 and 9, however, the top, bottom and intermediate wires are provided with clips 114 which are wrapped around the top, bottom and intermediate border wires and around the appropriate turn of the adjacent coil spring 110.

As outlined above, the top border wire and the bottom border wire may be made in a form to define any two dimensional geometric outline, for example, but not necessarily, a rectangle. The coil springs 110 are positioned at each corner of the mattress and attached to the border wire intermediate points, as shown in FIG. 12, to provide an adequate support for the mattress.

The intermediate border wire 113 may be connected to a cover part 115 by hog rings, similarly to the disclosure of FIG. 9 hereof at item 18, or it could be connected by forming a seam as indicated at 118 wherein the upper part of the cover is first wrapped around the center bar 113 and then stitched. The bottom part 130 of the cover then is stretched around the border wire 112 and stitched at 118.

Thus, the cover parts 115 and 130 are fixed to the center wire 113 as well as to the center turn of the coil springs 110 by means of the clips 114. Since the center wire 113 is slightly inside a plane passing through the edge of the border wires 112 and 111, the cover parts 115 and 130 will be held slightly inside the upper and lower marginal wires.

The mattress can have a conventional felt padding 116 and sisal pads 117. The cover parts 119 will be placed over the top as well as over the parts 115 and 130. The parts 115 and 130 may be stitched at seams 140.

Handles, like the handle 150, may be attached to the wire 113. The handle 150, in the embodiment shown in FIG. 12 may be in the form of a heavy wire or rod, bent at the corners shown so that the legs of the handles extend perpendicular to the center border wire 113 and the wire may be bent around the center wire 113 at 151, as shown. Grommets 152 may be fixed to the cover 160. These grommets slidably receive the legs of the handle. A hand-engaging member 153, FIGS. 15 and 16, may be provided with a groove 154 that receives the handle 150 to form a comfortable hand-engaging portion.

The embodiment of the handle shown in FIG. 14 shows the handle as supported on the center border wire 113 with the cover portions 115 and 130 supported thereon as shown in FIG. 12; however, in this embodiment, the cover portions 115 and 130 are not sewn around the border wire. The handle is indicated at 250 and has its legs 251 bent around the center border wire 113 and slightly flared out at 154 so that the handle may be inserted through openings 255 in the cover portion and the center border wire 113 received in the mouth which is defined by the ends 254 and the main portion of the handle at legs 251. When the handle is pulled outwards, the border wire 113 will snap into the space as shown in FIG. 14; thus, a self-locking handle is formed.

The self-locking handles will be inserted through the eyelets or grommets 152 which have been placed in the border of the finished mattress indicated at 160. The small clip hooks on the handle will pass through the eylets 152 and the hook in the handle will hook onto the border wire 113. Then, as the operator pulls the handle outwards, the mouth of the clip rides over the center wire and causes it to spread, thereby allowing the center wire to pop into the clip into the position shown in FIG. 12.

FIGS. 17 to 21 of the drawings show an additional embodiment of a handle structure for bed springs and the like.

In the manufacture of bed springs and innerspring mattresses, it is customary to provide such articles with a cover of fabric, which completely encloses the spring assembly, and to provide the cover with handles for the lifting and turning of the assembly. The cover may also include pads for the springs, and the handles are customarily attached to the longitudinally extending sidewall portion of the fabric cover between the upper and lower walls thereof, by means of grommets, or the like.

The handles in this type of structure are usually more or less straplike, and due to their attachment only to the fabric of the cover, the fabric often becomes stretched and deformed or torn, and the handles become detached.

The spring assembly may include vertically spaced, generally rectangular upper and lower frames to which spaced apart coil springs are attached yieldingly to hold the frames in spaced relation, and attempts have been made in the past to connect the handles to this frame so as to relieve the strain on the fabric cover. These attempts, however, did not prove satisfactory.

Briefly described, the handle structure as shown in FIGS. 17 to 21 of the present disclosure, includes an elongated handle member of straplike configuration having longitudinally spaced openings by which the handle is attached to the fabric of the assembly by grommets which provide openings through which elongated connector elements may be inserted for connection to intermediate turns of spaced apart coils of the springs to connect the handles thereto.

The connector elements are formed with head portions at their outer ends adapted to seat on the outer ends of the grommets and at their inner ends with slotted portions in which an elongated rodlike connecting member engageable with intermediate turns of the coils springs may be inserted to connect the inner ends of the elements to the springs. The connector elements are also formed with laterally extending lugs positioned for engagement at their free ends with the internal surfaces of the grommets to guide and brace the connector elements in the grommets, and with bracelike projections spaced inwardly beyond the lugs, which are engageable with the inner ends of the grommets when the connector elements are inserted therethrough to hold the elements against longitudinal movement outwardly of the grommets. The connector elements may be formed of suitable material, such as metal or plastics, and the bracelike projections are of flexible character to allow the same readily to be contracted so as to pass through the grommets for coaction with the outer end heads of the elements, securely to connect the elements to the grommets.

In the examples shown in FIGS. 17 to 21, the handle structure of the invention is intended for its use with a bed spring mattress or similar construction having coil springs such as 310, which are arranged in spaced apart relationship between upper and lower pads 312 and 314, the latter pads being of a usual type having inner and outer fabric portions 316 and 318, respectively, and forming a cover for the mattress.

The pad of the mattress may be of continuous type, extending about the entire, generally rectangular, structure of the mattress frame, or the spring structure may include upper and lower rectangular frame parts, not shown, which are yieldingly held in spaced apart parallel relationship by the springs 310, as commonly provided in bed springs and mattresses of the box or innerspring type.

The pad or cover of the mattress may have the usual longitudinally spaced grommets 320 located in the longitudinal sidewalls of the mattress for the attachment thereto of external handles as intended for use in lifting a mattress.

The handle structure of the invention includes a strap-like handle member 322 formed with perforated, generally disclike, enlarged end portions 324, each of which end portions may have an annular recess 326 in its outer face, in whose interior the grommet 320 is extended at its outer end to connect the handle to the cover portion of the mattress, as best viewed in FIG. 20.

The grommets 320 may extend at their inner ends through washers 328, positioned in engagement with the inner face of the mattress cover, to provide an extended area of contact by which the grommets are secured in place.

For the purpose of connecting the end portions 324 of the handle 322 to the inner spring structure of the mattress, elongated connector elements 330 are provided, which may be formed of any suitable material, such as metal, plastics, or the like, and which are adapted to be extended through the grommets 320 and connected at their inner ends to the coil springs 310. Each of the connector elements 330, in the example shown, has a shank or stem portion 332 of rectangular or other convenient shape in cross section, which is formed at its inner end with an enlarged portion 334 having a longitudinal slot 336 therein and an opening 338 through one sidewall of the slot 336 to permit a connecting member 350, in the form of a wire or a rod, to be inserted through the opening 338 into the slot 336.

At its outer end, the connector element 330 has a head 340 formed with an outer, disclike portion 342, of larger diameter than the internal diameter of the grommet 320 and which seats against the outer end of the grommet, and an inner annular portion 344 which fits within the grommet inwardly of the outer end thereof, as best seen in FIG. 20. Inwardly of the outer end head 340, the connector element 330 is formed with laterally extending projections 346 which extend radially outwardly for engagement at their outer ends with the inner surface of the grommet, to serve as a guiding means. The invention also includes the rod or bar 350 which may be extended in engagement with corresponding turns of the coil springs 310, and which may be inserted in the element 330 of the handle 322 into the slots 336 of the element to connect the elements to the springs. The bar or rodlike connecting member 350 is preferably formed with laterally bent end portions 352 to prevent the latter from slipping longitudinally out of the slots 336 of the connector elements when positioned therein.

In assembling the handle structure, constructed as described hereinabove, the connector elements 330 may be readily inserted through the grommets 320, the projections 348 being sufficiently flexible to enable the same to be pushed through the grommets and to expand outwardly for engagement with the inner end of the grommet to brace the elements thereon. When the connector elements have been thus inserted, the projections 346 will be in engagement with the internal surface of the grommet further to brace the elements thereon, while the head portion 340 will be in engagement with the outer end of the grommets to hold the outer ends of the braces 48 in contact with the inner ends of the grommets. It will be apparent that, by so doing, the connector elements will be securely attached to, and supported by, the grommets.

With the connector elements thus positioned, the rodlike connecting member 350 may be readily inserted through a number of the coil springs 310, as shown in FIGS. 18 and 19, and inserted through the openings 338 of the connector elements into the slots 336 thereof, whereby the connector elements will be securely connected to the coil springs.

It will be noted that the barlike connecting members 350 may be inserted at any suitable location mediate the ends of the coil springs 310, so that the connector elements 330 are positioned most effectively to connect the handle 322 to the spring, and so that the strain applied to the mattress by lifting it by the handles 322 will be transferred largely to the inner springs of the mattress, thus preventing tearing of the mattress cover or pulling out of the grommets.

While the invention has been particularly shown and described in connection with a few exemplary embodiments thereof, it will be understood that modifications and changes may be introduced therein which are well within the purview of a skilled technician, without thereby departing from the scope of this invention as defined in and by the claims appended hereto.

What is claimed is:

1. In an innerspring mattress construction of the type comprising an array of springs surrounded by a cover having a sidewall, and a handle mounted on the sidewall, the improvement wherein the handle has an opening therethrough; a grommet is mounted in the sidewall of the cover, said grommet extending through said handle opening and engaging the surrounding outer surface of the handle to retain it on said sidewall; and means for connecting said grommet to one of said springs so that lifting forces on the handle will be transferred to said spring, said connecting means comprising a stem portion extending through said grommet and adapted to be connected at its inner end to said spring, head means for engaging the outer end of said grommet to limit inward movement of said connecting means, and locking means adapted to engage the inner end of said grommet when said head means engages said outer end thereof to secure said connecting means to said grommet.

2. The mattress construction of claim 1 wherein said handle has an opening therethrough at each end thereof, and a pair of grommets are mounted on said sidewall, each grommet extending through one of said handle openings.

3. The mattress construction of claim 1 wherein said springs are an array of coil springs disposed so as to occupy with their base circles the predominant portion of the mattress surface on both faces thereof.

4. The mattress construction of claim 1 wherein a washer is positioned between the inner surface of said cover and the inner end of said grommet to reinforce the portion of said cover adjacent to the inner end of said grommet.

5. The mattress construction of claim 1 wherein said stem portion has a slot near the inner end thereof to facilitate its connection to said spring.

6. The mattress construction of claim 5 further comprising a connecting rod adapted to engage said spring and to be received in said slot of said stem portion.

7. The mattress construction of claim 6 wherein said connecting rod extends through said spring and comprises bent portions at its ends to prevent movement of said rod out of said spring.

8. The mattress construction of claim 5 wherein said slot is recessed in said stem portion.

9. The mattress construction of claim 1 wherein said locking means comprise a plurality of flexible and resilient projections.

10. The mattress construction of claim 9 wherein said projections are adapted to be deformed inwardly when said stem portion is inserted through said grommet and are adapted to move outwardly into engagement with the inner surface of said grommet when said head portion engages the outer surface of said grommet.

* * * * *